US005832099A

United States Patent [19]

Wiener

[11] Patent Number: 5,832,099

[45] Date of Patent: Nov. 3, 1998

[54] SPEAKER SYSTEM HAVING AN UNDULATING RIGID SPEAKER ENCLOSURE

[76] Inventor: David Wiener, 10 Iron Canyon Ct., Park City, Utah 84060

[21] Appl. No.: 780,524

[22] Filed: Jan. 8, 1997

[51] Int. Cl.[6] ..... H04R 25/00

[52] U.S. Cl. ..... 381/386; 381/338; 181/199; 181/144; 181/145; 181/153

[58] Field of Search ..... 381/188, 205, 381/90, 159, 158; 181/153, 144, 199, 145; 84/1.16

[56] References Cited

U.S. PATENT DOCUMENTS

| | | | |
|---|---|---|---|
| D. 66,668 | 2/1925 | Bourne . | |
| D. 311,539 | 10/1990 | Franzini et al. | D14/221 |
| D. 364,871 | 12/1995 | Esslinger | D14/223 |
| 3,486,578 | 12/1969 | Albino | 181/31 |
| 3,750,838 | 8/1973 | Pyle, Jr. | 181/31 B |
| 3,816,672 | 6/1974 | Gefvert et al. | 179/115.5 R |
| 3,818,138 | 6/1974 | Sperrazza, Jr. | 179/1 E |
| 3,884,326 | 5/1975 | Orisek | 181/155 |
| 3,890,474 | 6/1975 | Glicksberg | 381/68 |
| 3,945,461 | 3/1976 | Robinson | 181/153 |
| 3,978,941 | 9/1976 | Siebert | 181/151 |
| 4,085,289 | 4/1978 | Schmideler | 381/86 |
| 4,164,988 | 8/1979 | Virva | 181/156 |
| 4,501,934 | 2/1985 | Wiener | 179/46 |
| 4,819,761 | 4/1989 | Dick | 381/158 |
| 5,173,575 | 12/1992 | Furukawa | 381/96 |
| 5,444,194 | 8/1995 | Reinke | 181/150 |
| 5,525,767 | 6/1996 | Fields | 181/155 |
| 5,664,020 | 9/1997 | Goldfarb et al. | 381/159 |
| 5,673,329 | 9/1997 | Wiener | 381/158 |

OTHER PUBLICATIONS

Soundsphere® Omni–Directional Loudspeakers brochure.

Soundsphere® Omni–Directional Loudspeakers For Schools brochure.

Soundsphere® Omni–Directional Loudspeakers In Restaurants brochure.

Soundsphere® Product Technical Information for Model Q–12.

Soundsphere® Product Technical Information for Model QB.

Four Jay Industries Pro Performance Loudspeaker System, 575 Series brochure.

Dawn Speaker Systems brochures.

*Primary Examiner*—Sinh Tran

*Attorney, Agent, or Firm*—David P. Gordon; David S. Jacobson; Thomas A. Gallagher

[57] ABSTRACT

A speaker system includes a rigid elongate speaker enclosure having first and second ends, a speaker driver mounted at the first end and directed outward, and a sound dispersion assembly mounted over the speaker driver. The speaker enclosure has a wall between the first and second ends which is provided with a plurality of undulations. The undulations define outer peaks and inner valleys. The first end preferably includes a curved surface which curves back from the plane of the driver. The second end of the enclosure is preferably provided with a port, but may also be provided with another driver directed outward. The enclosure is preferably molded from fiberglass reinforced polyester. According to a preferred embodiment of the invention, the speaker enclosure is substantially frustoconical in shape. The port may be provided with a flexible tube or a flexible tubular segment may be provided on the enclosure at the second end, or at some location between the first and second ends. With each embodiment several acoustic advantages are realized. The undulating wall of the speaker system randomizes the internal sound waves, thereby substantially preventing the creation of standing waves and providing a very stable non-flexing enclosure such that associated distortion is eliminated.

29 Claims, 6 Drawing Sheets

SPEAKER SYSTEM HAVING AN UNDULATING RIGID SPEAKER ENCLOSURE

BACKGROUND OF THE INVENTION

1. Field of the Invention

This invention relates broadly to loudspeaker systems and speaker enclosures. This invention is particularly related to speaker enclosures which eliminate standing waves and enclosure resonance.

2. State of the Art

Speaker systems typically include a rectilinear speaker enclosure having multiple flat surfaces and one or more speakers mounted on one of the flat surfaces. The designs of the enclosure and the speaker driver are each important when constructing a speaker system which reproduces sound.

An important variable with regard to the design of the enclosure is the elimination of standing waves and resulting distortion. When a speaker radiates sound waves, it does so from the front and rear of the speaker cone. The sound waves radiated from the rear of the speaker are exactly opposite in phase from the sound waves radiated from the front. The rearward sound waves reflect off the interior walls of the speaker enclosure, causing the speaker enclosure to radiate a low frequency hum and exhibit other negative acoustic artifacts. Additionally, the standing waves create an uneven acoustic impedance which affects the speaker cone movement and, in turn, affects the ability of the speaker to accurately radiate sound out the front of the speaker; i.e., the sound radiated from the speaker system becomes distorted.

One manner of reducing standing waves is to provide baffles behind the speaker cone and a damping material along the walls of the enclosure. Ideally, the baffles and damping material prevent the sound waves from bouncing off the interior surfaces of the speaker enclosure and thereby prevent propagation of standing waves. However, in practice it has been found that baffles and damping materials generally do not adequately control the standing waves for quality speaker systems. In addition, rectilinear speaker enclosures often imbue a 'boxiness' to the sounds being reproduced. Furthermore, the flat surfaces of rectilinear speakers enclosures flex and resonate, imparting additional distortion to the sound being reproduced.

Co-owned U.S. Pat. No. 4,501,934, for the SoundTube® speaker system, provides an alternative method for reducing standing waves. Rather than using a rigid speaker enclosure, the speaker enclosure includes a frame and a flexible, compressible tube stretched over the frame. A speaker is provided at each end of the tube and radiates outward. A baffle plate within the tube prevents the rearward radiated sound from the speakers from mixing. The flexible tube, even when stretched tightly, provides no flat surfaces on which rearward radiated sounds can be reflected into standing waves. In addition, the tube flexes to be variably tuned to low frequencies. However, construction of the SoundTube® is very labor intensive. The frame requires a complicated assembly. In addition, the flexible tube is made of industrial grade fiberglass coated PVC which varies in quality. Additional time is required to select and crop the PVC tubing for use.

SUMMARY OF THE INVENTION

It is therefore an object of the invention to provide a speaker enclosure for a speaker system which substantially prevents the creation of standing waves, enclosure flexing, and resulting distortion.

It is another object of the invention to provide a speaker enclosure for a speaker system which can quickly be assembled.

It is also an object of the invention to provide a speaker enclosure for a speaker system which uses materials having consistent quality and tolerances.

It is an additional object of the invention to provide a speaker enclosure for a speaker system which uses materials which are rigid and durable.

In accord with these objects which will be discussed in detail below, a speaker system broadly includes a rigid elongate speaker enclosure having first and second ends and a speaker driver assembly mounted at the first end and directed outward. The speaker enclosure has a substantially frustoconical wall between the first and second ends provided with a plurality of undulations. The undulations define outer peaks and inner valleys. The first end preferably includes a curved surface which curves back from the plane of the driver. The second end of the enclosure is preferably provided with a port, but may also be provided with another driver directed outward. The enclosure is preferably molded from fiberglass reinforced polyester.

According to a preferred embodiment of the invention, the speaker enclosure tapers from the first end to the second end and cross-sections of the speaker enclosure through various outer peaks and inner valleys have substantially varying diameters. Additionally, according to the preferred embodiment the speaker system is omnidirectional and a sound dispersion assembly is mounted to the speaker enclosure to omnidirectionally radiate sound waves from the speaker driver. According to another embodiment of the invention, the first and second ends have substantially the same diameter. In addition, the diameter of the speaker enclosure at each of the outer peaks is substantially a first diameter and the diameter of the speaker enclosure at each of the inner valleys is substantially a second diameter, which is less than the first diameter. The speaker enclosure is generally tubular in design. According to yet another embodiment, the port at the second end is provided with a flexible tube. According to other embodiments, a flexible tubular segment is provided on the enclosure at the second end, or at a location between the first and second ends.

With the above embodiments several important acoustic advantages are realized. First, the undulating wall of the speaker system randomizes the internal sound waves, thereby preventing the creation of standing waves. Second, the curved surfaces provide a very stable and rigid enclosure which does not flex and does not resonate. Third, the flexible tubular segment enables the speaker enclosure to be variably tuned with respect to low frequency. Fourth, unlike conventional speakers which typically have flat mounting surfaces, the curvilinear surface for mounting the speaker driver assembly prevents the enclosure from being subject to unwanted reflection distortion. In addition, the materials of the speaker system can be obtained in relatively consistent quality and molding of the speaker enclosure is a relatively easy procedure.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
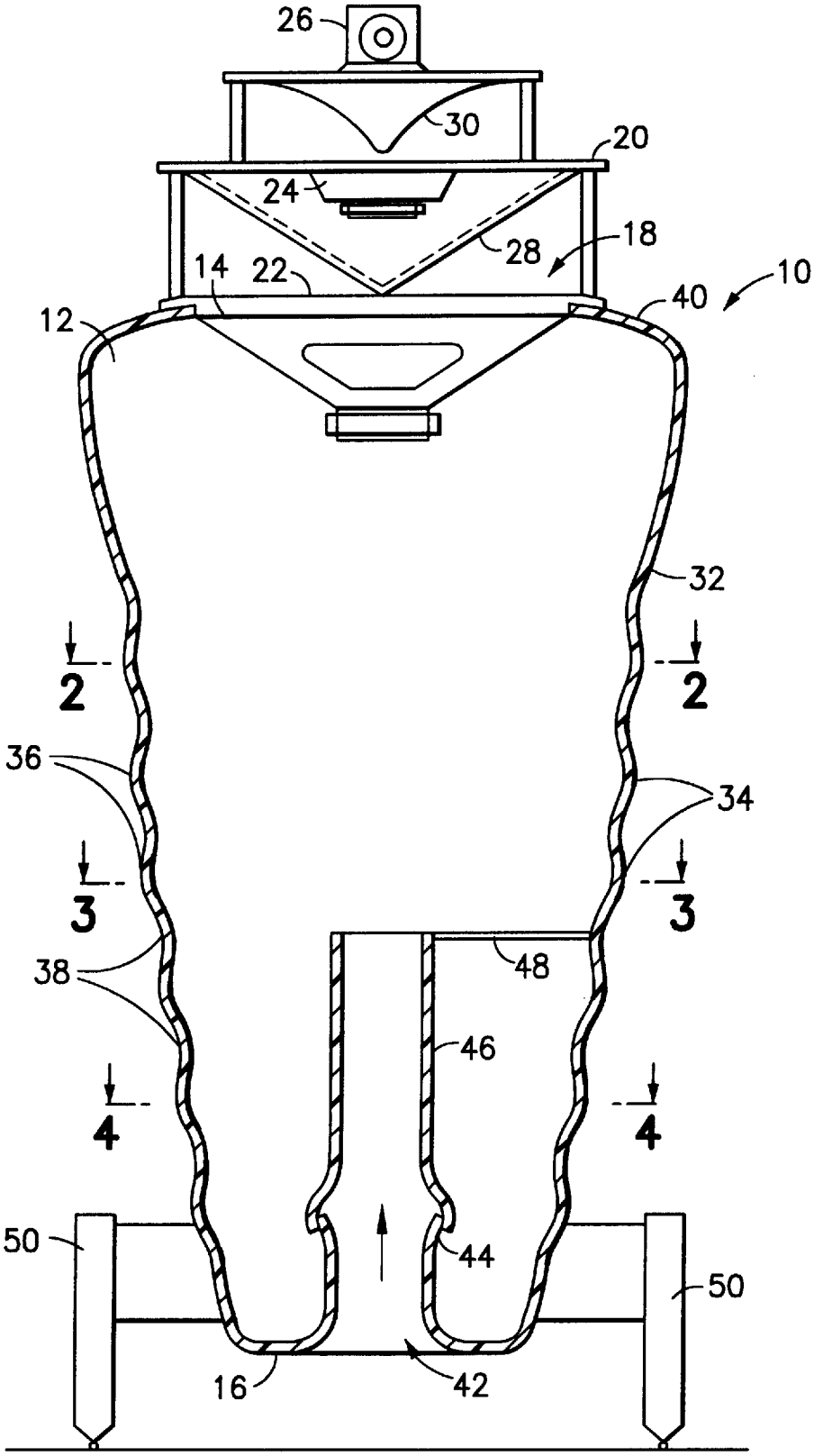
FIG. 1 is a section view of a speaker system according to a first embodiment of the invention.

Turning now to FIG. 1, a speaker system 10 is shown. The speaker system 10 generally includes a rigid elongate speaker enclosure 12 having first and second ends 14, 16 and a speaker driver assembly 18 mounted at the first end 14 and directed outwardly therefrom. According to a preferred aspect of the invention, the speaker system 10 is provided with a sound dispersion assembly 20 mounted to the speaker enclosure to omnidirectionally radiate the sound of the speaker driver assembly 18. The speaker driver assembly 18 includes woofer 22, midrange 24, and tweeter 26 drivers. The sound dispersion assembly 20 includes a woofer lens 28 and a midrange lens 30. The speaker driver assembly and sound dispersion assembly are described in detail in co-owned U.S. Ser. No. 08/410,142, which is hereby incorporated herein by reference in its entirety.

Figure 2:
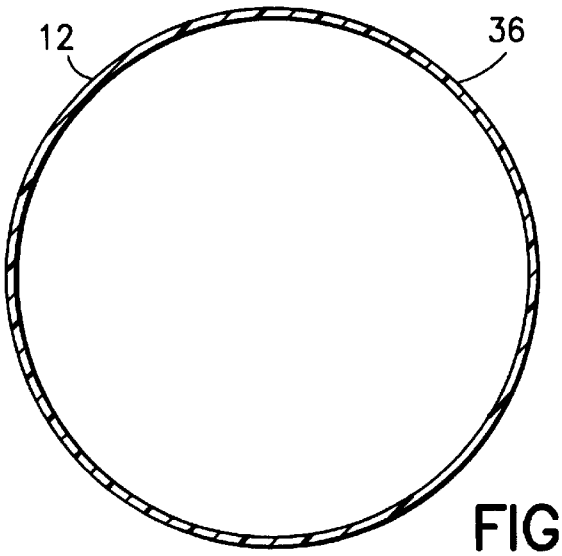
FIG. 2 is a cross-section across line 2—2 in FIG. 1.
Figure 3:
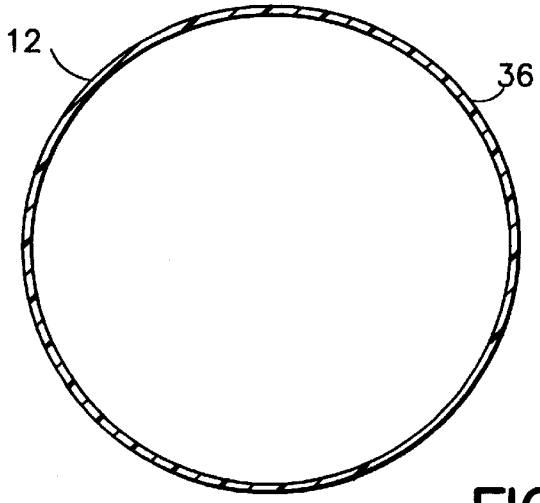
FIG. 3 is a cross-section across line 3—3 in FIG. 1.
Figure 4:
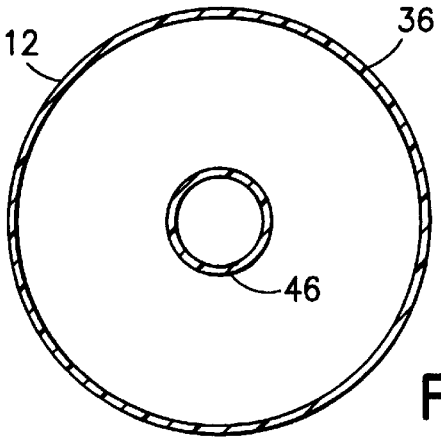
FIG. 4 is a cross-section across line 4—4 in FIG. 1.

The speaker enclosure 12 is preferably molded from fiberglass reinforced polyester to have a substantially frustoconical wall 32 provided with a plurality of undulations 34 between the first 14 and second 16 ends. The undulations define outer peaks 36 and inner valleys 38. Cross-sections through the speaker enclosure are preferably circular shaped. Being substantially frustoconical, the speaker enclosure 12 tapers from the first end 14 to the second end 16, such that a series of cross-sections from the first end 14 to the second end 16 in a direction parallel to the plane of the woofer driver 22 and through the outer peaks 36 will show the speaker enclosure 12 having a decreasing diameter with each successive cross-section (FIGS. 2–4). The result will be the same with a series of cross sections through the inner valleys 38 of the speaker enclosure. This rigid, curvilinear, and undulating wall design substantially randomizes the internal waves and thereby substantially prevents the creation of standing waves and other random waves. In addition, the design in conjunction with the materials for construction provides a very stable and rigid enclosure which is substantially non-flexing. As a result, the speaker system is much less prone to distort relative to conventional speakers.

Turning back to FIG. 1, the first end 14 preferably includes a curved surface 40 which curves back from the plane of the woofer driver 22. As a result, sound radiating from the woofer driver 22 is prevented from producing negative reflections off of the speaker enclosure 12. The second end 16 of the enclosure is preferably provided with an axial port 42. The port 42 preferably tapers inward from the second end 16 and preferably flares at the end 44 opposite the second end. Preferably, a short section of flexible hose 46 is friction-fit over the flared end 44 of the port. The end of the hose 46 opposite the port is preferably attached to one end of a bracket 48. The other end of the bracket 48 is preferably attached to the interior wall of the speaker enclosure 12. The flexible hose 46 coupled to the port 42 eliminates the fixed tuning point effect ('boxiness') usually present with rigid speaker enclosures. The hose is preferably made of a PVC containing an integral helical wire frame, such as that sold under the name R2 by Flexaust Corp. In order that air may satisfactorily move through the port, the second end 16 of the speaker enclosure 12 is preferably provided with stands 50, or otherwise suspended over a floor surface.

Figure 6:
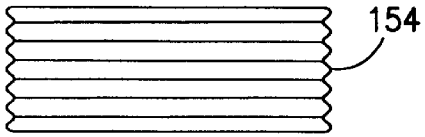
FIG. 6 is a side elevation view of a flexible hose segment according to the second embodiment of the invention.
Figure 7:
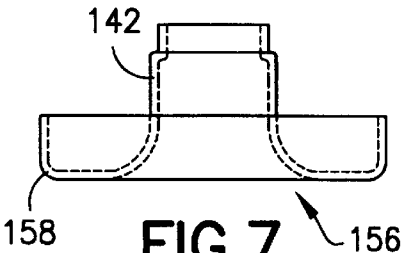
FIG. 7 is a side elevation view of a port component according to the second embodiment of the invention.
Figure 5:
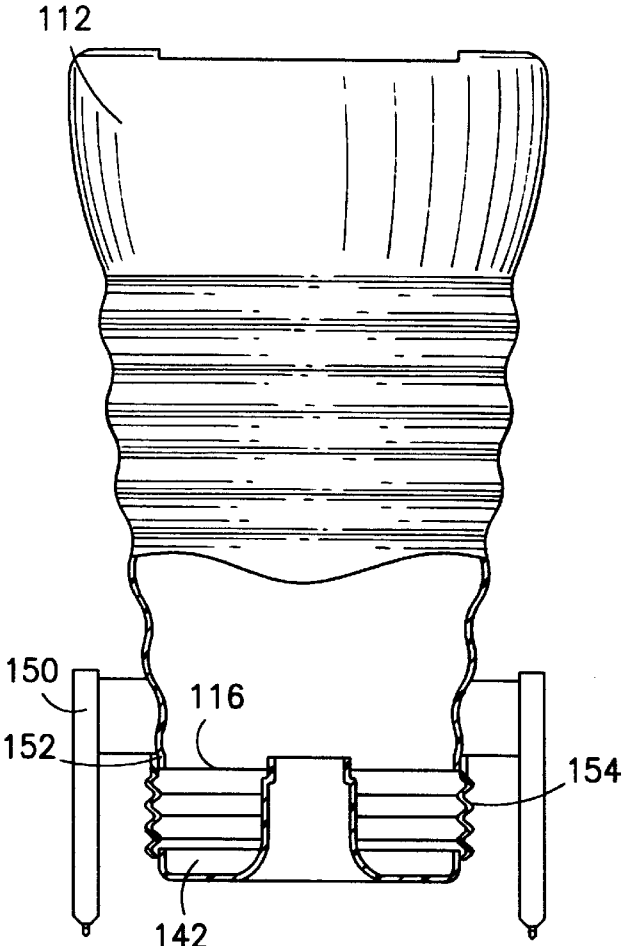
FIG. 5 is a section view of a speaker system according to a second embodiment of the invention.

Referring to FIG. 5, a second embodiment of a speaker system, substantially similar to the speaker system of the first embodiment (with like parts having numbers incremented by 100), is shown. The second end 116 of the speaker enclosure 112 is substantially open and provided with a lip 152. Referring to FIGS. 5, 6, and 7, one end of a segment of an axially flexible hose 154 (or bellows) is mounted onto the lip 152. A port component 156 having a central port 142 and a relatively larger annular coupling portion 158 is mounted on the other end of the hose 154 at the annular coupling portion 158 to close off the second end of the speaker enclosure except at the port. Stands 150 may be mounted to the speaker enclosure above the flexible hose 154.

The interposition of the flexible segment of hose 154 between the second end 116 and the port component 156 permits the length of the enclosure 112 to automatically vary with any low frequency waves radiated rearward from the speaker driver assembly (not shown), and to thereby provide a variably-tuned speaker enclosure.

Figure 8:
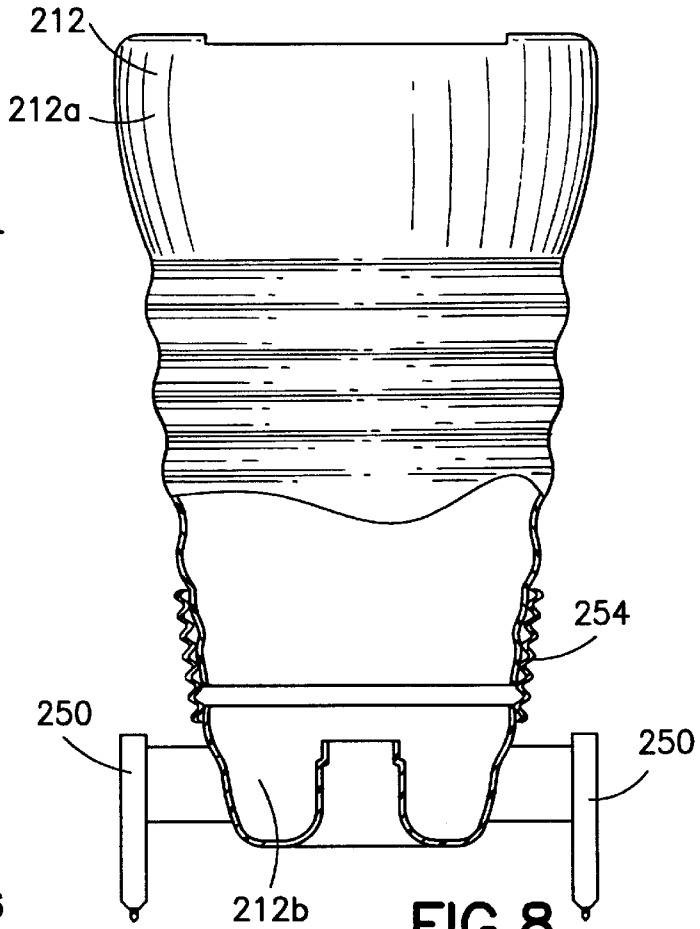
FIG. 8 is a partial section view of a speaker system according to a third embodiment of the invention.

Turning to FIG. 8, a third embodiment of a speaker system, substantially similar to the speaker system of the first embodiment (with like parts having numbers incremented by 200), is shown. The speaker enclosure 212 is molded to the shape described for the first embodiment and then approximately the lower one-fifth of the enclosure is separated from the upper four-fifths, thereby forming upper 212*a* and lower 212*b* portions. A port 242 is provided in the lower portion 212*b*. A segment of flexible hose 254, preferably made of a PVC containing a wire frame, is mounted between the upper 212*a* and lower 212*b* portions. Stands 250 may be mounted to the lower portion of the speaker enclosure.

Figure 10:
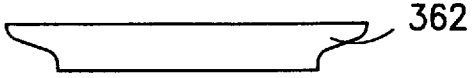
FIG. 10 is a side elevation view of a collar component of a port assembly according to the fourth embodiment of the invention.
Figure 11:
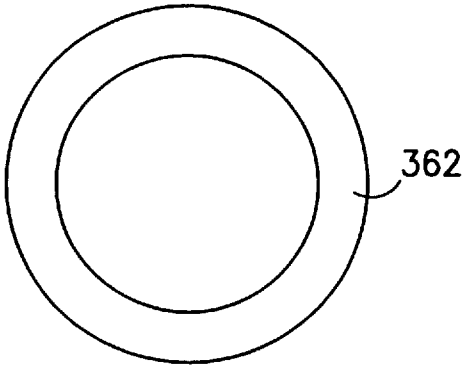
FIG. 11 is a top view of the collar component of the port assembly according to the fourth embodiment of the invention.
Figure 9:
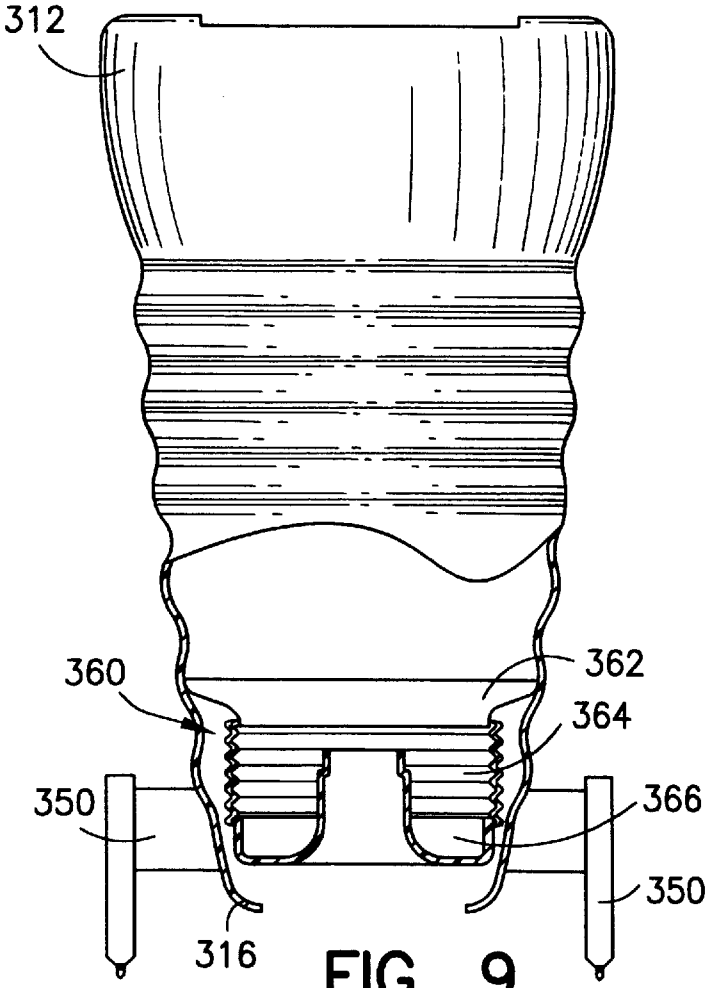
FIG. 9 is a partial section view of a speaker system according to a fourth embodiment of the invention.

Referring to FIG. 9 through 11, a fourth embodiment of a speaker system, substantially similar to the speaker system of the first embodiment (with like parts having numbers incremented by 300), is shown. The second end 316 of the speaker enclosure 312 is substantially open. An internal port assembly 360 is mounted in the lower interior of the speaker enclosure 312. The port assembly 360 includes a collar component 362 (distinctly shown in FIGS. 10, and 11), a flexible hose segment 364 (similarly shown in FIG. 6), and a port component 366 (similarly shown in FIG. 7). The collar component 362 is fixed to the interior of the speaker enclosure, preferably by an epoxy, and one end of the hose segment 364 is coupled to the collar component 362. The port component 366 is coupled to the other end of the hose segment 364. Stands 350 may be mounted anywhere along the speaker enclosure 312. As such, stand 350 placement is independent of the hose segment 364 placement.

Figure 12:
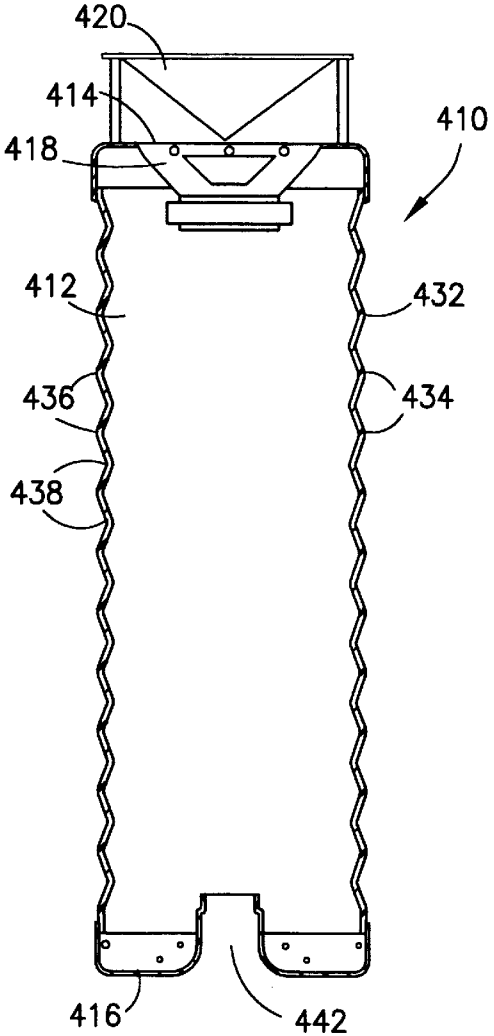
FIG. 12 is a section view of a speaker system according to a fifth embodiment of the invention.

Turning to FIG. 12, a fifth embodiment of a speaker system 410 is shown. The speaker system 410 generally includes a rigid elongate speaker enclosure 412 and a speaker driver assembly 418. The speaker enclosure has a first end 414 with an opening for receiving a speaker driver and a second end 416 provided with a port 442. The speaker driver assembly 418 (only single driver shown) is mounted in the opening of the first end 14 of the speaker enclosure and is directed outward. In a preferable omnidirectional system, a sound dispersion assembly 420 (only a single dispersion element shown) is mounted over the speaker driver assembly 418.

The speaker enclosure 412 has a molded substantially tubular wall 432 provided with a plurality of undulations 434 between the first 414 and second 416 ends. The undulations define outer peaks 436 and inner valleys 438. The first 414 and second 416 ends have substantially the same diameter. Cross sections through the enclosure are preferably circular shaped. In addition, the diameter of the speaker enclosure at each of the outer peaks 436 is substantially a first diameter and the diameter of the speaker enclosure at each of the inner valleys 438 is substantially a second diameter, which is less than the first diameter.

Figure 13:
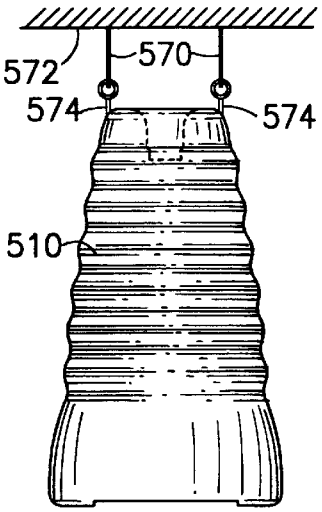
FIG. 13 is a side elevation view of a speaker system according to the invention suspended from an overhead support.
Figure 14:
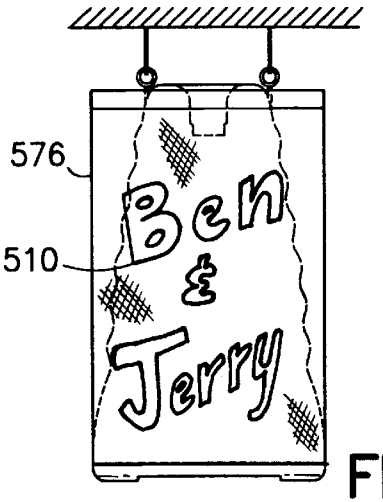
FIG. 14 is a side elevation view of a speaker system suspended from an overhead support and provided with a graphically imprinted fabric sleeve according to the invention.

Turning to FIG. 13, it will be appreciated that each of the above embodiments may not only be mounted on stands, but may also be suspended from a ceiling or other support. For example, mounting brackets or support cables 570 can be attached between an overhead support 572 and mounting hardware, e.g. eye bolts 574, on the speaker system 510. Referring to FIG. 14, it will also be appreciated that each of the above embodiments may be covered in a fabric sleeve 576 for decorative purposes. In addition, the sleeve 576 may be imprinted with a trademark insignia or slogan for advertising purposes.

Figure 15:
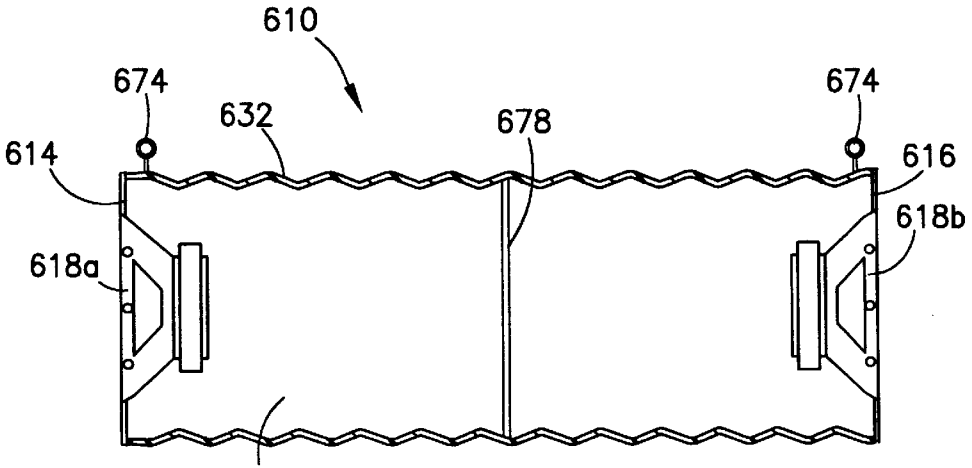
FIG. 15 is a section view of a dual speaker system according to a sixth embodiment of the invention.

Referring to FIG. 15, a sixth embodiment of a speaker system (substantially similar to the fifth embodiment, with like parts having numbers incremented by 200) is shown. The speaker system 610 includes a speaker enclosure 612 having a first end 614 provided with a first opening for receiving a first speaker driver 618*a,* a second end 616 provided with a second opening for receiving a second speaker driver 618*b,* and a molded substantially tubular undulating wall 632 between the first and second ends. A baffle 678 is provided in the interior of the speaker enclosure between the two speaker drivers. Eye bolts 674 are provided for suspending the speaker system.

Figure 16:
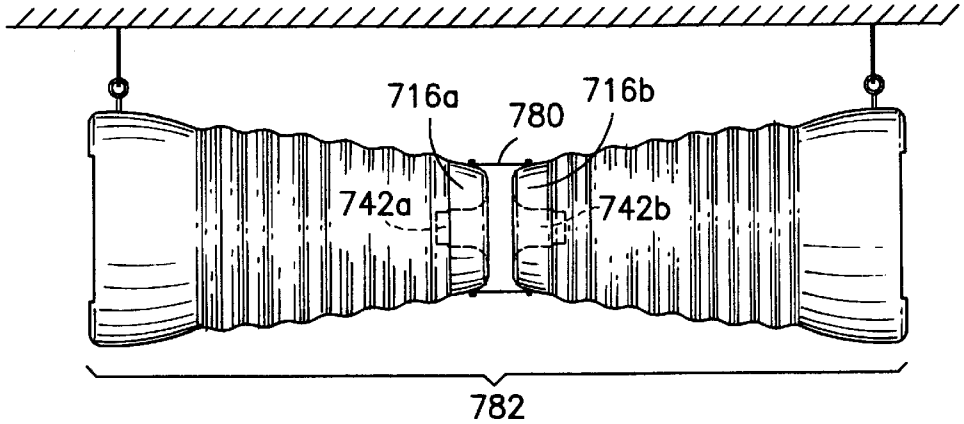
FIG. 16 is a side elevation view of a dual speaker system according to an eighth embodiment of the invention.
Figure 17:
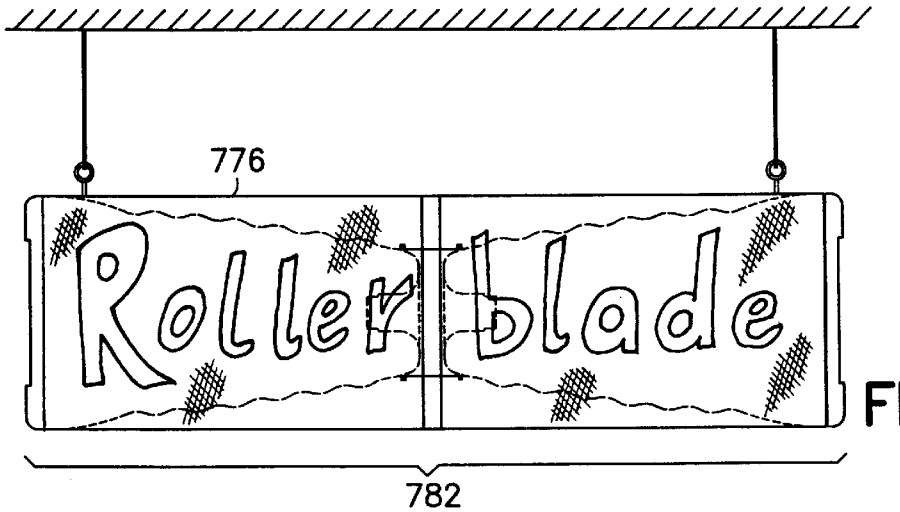
FIG. 17 is side elevation of a dual speaker system provided with a graphically imprinted fabric sleeve according to the invention.

Turning to FIG. 16, it will also be appreciated that each of the above speaker systems having a single speaker driver assembly can be coupled to one other speaker system using a dual bracket 780 to create a dual speaker system 782. The second end 716*a,* 716*b* of each individual speaker system is preferably bolted to the dual bracket 780. The dual bracket 782 secures the second ends 716*a,* 716*b* while spacing apart the second ends 716*a,* 716*b* to permit air to flow through the vents 742*a,* 742*b* located at the second ends. The dual speaker system 782 may be suspended from an overhead support. In addition, referring to FIG. 17, the dual speaker system may be covered in a fabric sleeve 776 for decorative purposes. Furthermore, the sleeve 776 may be imprinted with a trademark insignia or slogan for advertising purposes.

There have been described and illustrated herein several embodiments of a speaker system. While particular embodiments of the invention have been described, it is not intended that the invention be limited thereto, as it is intended that the invention be as broad in scope as the art will allow and that the specification be read likewise. Thus, while fiberglass reinforced polyester has been disclosed as a preferred material for molding the speaker enclosure, it will be appreciated that other moldable materials which become rigid, such as ABS and styrene, may also be used. In addition, while the first end is preferably curved, it will be appreciated that the first end may be relatively planar. Furthermore several of the embodiments have been disclosed to have a port, it will be understood that no port need be provided. Moreover, while the port has been described in certain embodiment to flair at the end opposite the closed end, it will be appreciated that the port need not flair and may even continue to taper inward. In addition, while the hose has been disclosed to be friction-fit to the port, it will be appreciated that the hose may be coupled to the port by an elastic band, a metal band, or other coupling means. Also, while the hose has been described as a PVC material containing an integral helical wire, it will be appreciated that the hose may be made of other flexible materials. Moreover, while particular speaker driver assemblies and sound dispersion assemblies have been incorporated by reference for use with the speaker systems, it will be appreciated that other speaker driver assemblies and sound dispersion assemblies can be used as well. In addition, while some embodiments of the speaker system have been described with respect to omnidirectional speakers, it will be appreciated that each of the speaker systems may be omnidirectional or directional, i.e., the speaker systems do not require a sound dispersion assembly but may be provided with one. Furthermore, while the speaker enclosure has been shown to have both interior and exterior wall surfaces which undulate, it will be appreciated that only the interior wall surface need undulate to cancel the standing waves and distortion, and that the exterior wall surface can be smooth. Moreover, while the speaker enclosure has been described to have a circular cross section, it will be appreciated that the speaker enclosure may have other cross sections, for example, ovoid. Also, while eye bolts have been disclosed for use in suspending the individual and dual speaker systems, it will be appreciated that other mechanisms and/or hardware for suspending the speaker systems may be used. It will therefore be appreciated by those skilled in the art that yet other modifications could be made to the provided invention without deviating from its spirit and scope as so claimed.

I claim:

1. A loudspeaker system, comprising:

a) a rigid elongate speaker enclosure having first and second ends and a self-supportingly rigid wall having a plurality of rigid, smooth undulations located between said first and second ends; and b) a first speaker driver assembly mounted on said first end of said speaker enclosure and facing outward from said speaker enclosure.

2. A loudspeaker according to claim 1, wherein:

cross sections through said rigid wall define inner diameters and outer diameters.

3. A loudspeaker system according to claim 2, wherein:

said speaker enclosure is substantially frustoconical.

4. A loudspeaker system according to claim 2, wherein:

said speaker enclosure is substantially cylindrical.

5. A loudspeaker system according to claim 2, further comprising:

c) a flexible hose having a first end and a second end; and d) a port component, wherein said second end of said speaker enclosure is substantially open, and said first end of said flexible hose is coupled to said second end of said speaker enclosure, and said second end of said flexible hose is coupled to said port component.

6. A loudspeaker system according to claim 2, further comprising:

c) an internal flexible port assembly having an annular coupling collar, a flexible hose, and a port component, said collar being coupled to the interior of said speaker enclosure and said flexible hose being coupled between said collar and said port component, wherein said second end of said speaker enclosure is substantially open.

7. A loudspeaker system according to claim 2, wherein:

said second end of the said speaker enclosure is provided with a port portion.

8. A loudspeaker system according to claim 7, further comprising:

d) a flexible hose having a first and second ends, said first end coupled to said port portion.

9. A loudspeaker system according to claim 8, wherein:

said port portion flares outward at an end opposite said second end.

10. A loudspeaker system according to claim 7, wherein:

said port portion tapers inward from said second end.

11. A loudspeaker system according to claim 2, wherein:

said first end is non-planar.

12. A loudspeaker system according to claim 2, further comprising:

c) a fabric sleeve extending over said speaker enclosure.

13. A loudspeaker system according to claim 2, further comprising:

c) a first sound dispersion means coupled to said speaker enclosure for dispersing sound radiated from said first speaker driver assembly.

14. A loudspeaker system according to claim 13, further comprising:

d) a second speaker driver assembly mounted on said second end of said speaker enclosure and facing outward from said speaker enclosure; and e) a second sound dispersion assembly coupled to said speaker enclosure such that sound radiated from said second speaker driver assembly is dispersed by said second sound dispersion assembly.

15. A loudspeaker according to claim 2, wherein;

each cross-section defines concentric inner and outer diameters.

16. A loudspeaker system according to claim 1, wherein:

said rigid wall substantially continually changes in radius in all directions, such that when said speaker assembly creates sound waves, said speaker enclosure randomizes sound waves within said speaker enclosure.

17. A loudspeaker system, according to claim 1, wherein:

said rigid wall has interior and exterior surfaces, each of which are provided with said plurality of undulations.

18. A loudspeaker according to claim 1, wherein:

said undulations each having a substantially like-sized peak.

19. A loudspeaker system, comprising a) a first loudspeaker assembly having i) a first rigid elongate speaker enclosure having first and second ends, a first self-supportingly rigid wall having a plurality of rigid, smooth undulations located between said first and second ends, and a first axis, ii) a first speaker driver assembly mounted on said first end of said speaker enclosure and facing outward from said speaker enclosure, and iii) a first sound dispersion means coupled to said speaker enclosure for dispersing sound radiated from said first speaker driver assembly;

b) a second loudspeaker assembly having i) a second rigid elongate speaker enclosure having third and fourth ends, a second self-supportingly rigid wall having a plurality of rigid, smooth undulations located between said third and fourth ends, and a second axis, ii) a second speaker driver assembly mounted on said third end of said second speaker enclosure and facing outward from said second speaker enclosure, and iii) a second sound dispersion means coupled to said second speaker enclosure for dispersing sound radiated from said second speaker driver assembly; and c) a bracket means for coupling said first loudspeaker assembly to said second loudspeaker assembly, such that said first speaker driver assembly and said second speaker driver assembly are oppositely directed and said first axis is substantially co-linear with said second axis.

20. A loudspeaker system according to claim 19, wherein:

said first speaker enclosure and said second speaker enclosure each have circular cross sections substantially along their entire lengths.

21. A loudspeaker system according to claim 19, wherein:

said first speaker enclosure and said second speaker enclosure are each frustoconical.

22. A loudspeaker system according to claim 19, wherein:

said second end of the said first speaker enclosure is provided with a first port portion and said fourth end of said second speaker enclosure is provided with a second port portion.

23. A loudspeaker system according to claim 22, further comprising:

d) a first flexible hose coupled to said first port portion; and e) a second flexible hose coupled to said second port portion.

24. A loudspeaker system according to claim 19, further comprising:

d) first and second flexible hoses, each having a first end and a second end; and e) first and second port components, wherein said second end of said first speaker enclosure is substantially open, and said first end of said first flexible hose is coupled to said second end of said first speaker enclosure and said second end of said first flexible hose is coupled to said first port component, and said first end of said second flexible hose is coupled to said fourth end of said second speaker enclosure and said second end of said second flexible hose is coupled to said second port component.

25. A loudspeaker system according to claim 19, further comprising:

c) a first internal flexible port assembly having a first annular coupling collar, a first flexible hose, and a first port component, said first collar being coupled to the interior of said first speaker enclosure and said first flexible hose being coupled between said first collar and said first port component; and d) a second internal flexible port assembly having a second annular coupling collar, a second flexible hose, and a second port component, said second collar being coupled to the interior of said second speaker enclosure and said second flexible hose being coupled between said second collar and said second port component wherein said second end of said first speaker enclosure is substantially open and said fourth end of said second speaker enclosure is substantially open.

26. A loudspeaker system according to claim 19, wherein:

said first end and said third end are each non-planar.

27. A loudspeaker system according to claim 19, further comprising:

d) at least one sleeve extending over said loudspeaker system.

28. A loudspeaker system, comprising:

a) a rigid elongate speaker enclosure having first and second ends and a substantially self-supportingly rigid wall having a plurality of substantially identical rigid undulations located between said first and second ends; and b) a first speaker driver assembly mounted on said first end of said speaker enclosure and facing outward from said speaker enclosure.

29. A loudspeaker system, comprising:

a) a first loudspeaker assembly having i) a first rigid elongate speaker enclosure having first and second ends, a first self-supportingly rigid wall having a plurality of substantially identical rigid undulations located between said first and second ends, and a first axis, ii) a first speaker driver assembly mounted on said first end of said speaker enclosure and facing outward from said speaker enclosure, and iii) a first sound dispersion means coupled to said speaker enclosure for dispersing sound radiated from said first speaker driver assembly;

b) a second loudspeaker assembly having i) a second rigid elongate speaker enclosure having third and fourth ends, a second self-supportingly rigid wall having a plurality of substantially identical rigid undulations located between said third and fourth ends, and a second axis, ii) a second speaker driver assembly mounted on said third end of said second speaker enclosure and facing outward from said second speaker enclosure, and iii) a second sound dispersion means coupled to said second speaker enclosure for dispersing sound radiated from said second speaker driver assembly; and c) a bracket means for coupling said first loudspeaker assembly to said second loudspeaker assembly, such that said first speaker driver assembly and said second speaker driver assembly are oppositely directed and said first axis is substantially co-linear with said second axis.

* * * * *